US006578948B2

(12) United States Patent
Shima

(10) Patent No.: US 6,578,948 B2
(45) Date of Patent: Jun. 17, 2003

(54) INK JET RECORDING APPARATUS AND RECOVERY METHOD THEREOF

(75) Inventor: Takeaki Shima, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/066,622

(22) Filed: Feb. 6, 2002

(65) Prior Publication Data

US 2002/0126175 A1 Sep. 12, 2002

(30) Foreign Application Priority Data

Feb. 9, 2001 (JP) ..... 2001-033561

(51) Int. Cl.[7] ..... B41J 2/165
(52) U.S. Cl. ..... 347/29; 347/30; 347/32
(58) Field of Search ..... 347/30, 29, 32, 347/33

(56) References Cited

U.S. PATENT DOCUMENTS 5,670,997 A 9/1997 Sugimoto et al. ..... 347/30
6,406,123 B1 * 6/2002 Usui et al. ..... 347/29

FOREIGN PATENT DOCUMENTS

JP 60-151059 8/1985
JP 6-126947 5/1994

* cited by examiner

*Primary Examiner*—Huan Tran
(74) *Attorney, Agent, or Firm*—Fitzpatrick, Cella, Harper & Scinto

(57) ABSTRACT

An ink jet recording apparatus which discharges ink from an discharge port provided in the discharge port surface of recording device comprises a cap closely contacting said discharge port and covering said discharge port, sucking mechanism for sucking ink from the discharge port through the cap closely contacted the discharge port, gap forming mechanism for partially generating a gap between the cap and the discharge port surface, a communication valve for communicating the inside of the cap with atmosphere.

17 Claims, 12 Drawing Sheets

INK JET RECORDING APPARATUS AND RECOVERY METHOD THEREOF

BACKGROUND OF THE INVENTION

1. Field of the Invention

The present invention relates to an ink jet recording apparatus having a head recovery means and a recovery method thereof.

2. Related Background Art

Among recording systems for printers and the like, the ink jet recording system which performs recording on a recording medium by allowing ink to discharge from a discharge port (nozzle) has been widely adopted in recent years since it is a low-noise non-impact recording system which allows for a high-density and high-speed recording operation.

The ordinary ink jet recording apparatuses comprise driving means for driving a carrier which mounts a recording head (recording means), conveying means for conveying a recording paper, control means for controlling these means and the like. There are also available recording apparatuses such as those which apply pressure on the ink by using an electromechanical converter such as piezoelectric element, or those which irradiate electromagnetic wave such as a laser on the ink to heat the ink and, by this heating, allow the ink to bubble, or to allow the ink liquid to generate heat by the electromechanical converter having a heating resistance element and to bubble the ink liquid to generate energy for discharging ink from discharge ports of the recording head. Among them, the ink jet recording apparatuses of a system for discharging ink droplet by utilizing thermal energy can make a recording of high resolution since discharge ports can be arranged in high density. In particular, the recording head which uses an electromechanical converter element as an energy generating element can be easily made compact and, by applying the IC technology and the micro processing technique which have remarkably advanced in technology and reliability in the recent semiconductor manufacturing field, high density mounting by taking a full advantage of its merit can be made easy and the manufacturing cost thereof can be also reduced.

Such an ink jet recording apparatus is provided with a head recovery means for preventing a printing failure due to clogging in the discharge port. One of this head recovery means is such that, by covering a head with a cap, the ink is sucked from the discharge port by a suction pump through the cap so that high viscosity ink and minute contaminants in the inside of the recording head and ink supply flow path as well as bubbles in the ink are sucked from the top of the discharge port. The other one is such that the head surface is wiped by a flexible wiper blade so that fine contaminants and residual ink are removed and the head surface is put into a clean state. Another one is such that the recording head discharges a small amount of ink immediately before performing recording so as to maintain a steady discharge.

In the ink jet recording apparatus for printing while allowing these recording heads mounted on a carrier to reciprocate, a large capacity ink tank is required to reduce exchange frequency of the ink tank. In a simple constitution of mounting the recording head and the ink tank integrally on the carrier, since inertia of the ink tank mounted on the carrier increases, there has been known a method, wherein the ink tank is separated from moving parts such as the carrier and is fixedly arranged and a tube and the like is connected to the recording head on the carrier so as to supply the ink.

In such an ink jet recording apparatus, in order that the ink does not drop from the recording head at other than print driving, a minute negative pressure to an atmospheric pressure is always applied so that the ink discharge for printing and useless ink dropping prevention become compatible. However, when influenced by reciprocating movement of the carrier at the print driving in this state, the ink inside a connection tube flows to push out the ink inside the recording head, or the ink is sucked inside the connection tube, thereby causing fluctuation in the discharge amount, printing irregularity and non-discharge.

As a countermeasure, there has been known a technology in which an air bank is provided in the vicinity of the recording head between the tube and the recording head and an air buffer container is installed, which buffers pressure fluctuation due to the ink flow inside the tube and stabilizes the discharge by utilizing elasticity of the air. This air buffer container takes the upper part as the air bank and the lower part as an ink bank and has a function also of separating the air from the ink inside the tube where the air is mixed and sending the ink only to the recording head. However, this air buffer container is required to secure a necessary liquid surface height of the ink bank in order that the air does not approach the inside of the recording head from the air bank due to vibration of the liquid surface of the ink bank by the reciprocating movement of the carrier.

Also, in the other system, which conveys a recording medium and prints without scanning the carrier, there is available a method in which the air buffer container similar to the above described is installed for the purpose of separating the air mixed inside the ink. In this case also, it is necessary to secure the necessary liquid surface height of the ink bank inside the air buffer container.

The liquid surface height of the ink banks of these air buffer containers has a tendency to gradually fall by permeable approach of the air from the tube wall surface and bubble removal of ink dissolved gas and it is, therefore, necessary to continuously maintain the necessary liquid surface height. For example, regarding a maintaining method of the necessary liquid surface of the ink bank of the air buffer container in the ink jet recording apparatus which supplies the ink from one piece of the tube, there is a method in which a switching means is provided in the ink supply path and the ink supply path is closed so that the ink and the air inside the recording head are sucked by using the cap of the above described head recovery means and the suction pump and, after that, the ink supply path is opened and the ink is filled, thereby controlling the amount of reduced pressure inside the air buffer container so as to restore the necessary liquid surface.

The color ink jet recording apparatuses of recent years have become capable of full-color recording by using multicolor ink and discharging the ink from the discharge port corresponding to each color. Such color ink jet recording apparatuses reduce the distance among each discharge port as much as possible and perform suction recovery of a plurality of colors by the same cap for the purpose of miniaturization of the apparatus, improvement of impact accuracy of the ink on the recording paper and reduction of recording time by reduction of moving distance of the carrier.

When the cap is removed from the recording head after the discharge ports of a plurality of colors are sucked and recovered by the same cap, the ink which was mixed inside the cap adheres on the surfaces of the discharge ports of the recording head and flows inside the recording head from the discharge ports by minute negative pressure due to the above described ink dropping prevention and causes color mixing so that recording quality is remarkably deteriorated.

In order to solve such a trouble, it is necessary to prevent the ink from depositing on the discharge port surface of the recording head. Hence, for example, as disclosed in Japanese Patent Application Laid-Open No. 60-151059, there is adapted a method in which the cap and an air intake valve are connected to the tube and, by opening this air intake valve, the inside of the cap is communicated with the air to suck the ink remaining inside the cap and, after that, the cap is separated. However, when the air intake valve is opened, the inside of the cap is put into atmospheric pressure, which generates differential pressure with the inside of the recording head and, furthermore, when the amount of ink inside the cap is large, there is a fear that the surface of the ink rises due to the flow of the air from the air intake valve and the ink adheres on the surface of the discharge port and generates color mixture.

Also, as disclosed in Japanese Patent Application Laid-Open No. 6-126947, there is adopted a method in which a gap is made by shifting the cap, and an empty suction is performed and, after that, the position of the cap is changed and, with the surface of the discharge port of the recording head put in a completely leaked state, the empty suction is further performed. According to these methods, a rise of the ink surface due to flow of the air is not generated, but the empty suction is required twice and, during that time, there is a fear of generating flow of the ink inside the recording head and mixing of color.

Particularly, as described above, in the case where the liquid surface restoring operation inside the air buffer container is performed and the ink suction is performed by the same cap, when there is an irregularity in the ink amount inside the air buffer container of each color, an irregularity of the negative pressure inside the recording head is generated, and there has been a fear of the ink mixed inside the cap flowing backward from the discharge port and flowing inside the recording head.

SUMMARY OF THE INVENTION

One of the objects of the present invention is to provide an ink jet recording apparatus and its recovery method, for which there is no fear of depositing the ink on the discharge port surface from inside a cap without making the constitution and the process complicated.

Another object of the present invention is to provide the ink jet recording apparatus which discharges the ink from the discharge port provided in the discharge port surface of recording means having the cap closely contacted the discharge port surface to cover the discharge port, suction means for performing suction from the discharge port through the cap closely contacted the discharge port surface, gap forming means for partially generating a gap between the cap and the discharge port surface, and a communication valve which allows the inside of the cap to communicate with the atmosphere.

According to this constitution, flowing backward of the ink inside the cap to the inside of the discharge port and closely contacting the discharge port again of the ink sucked and mixed inside the cap can be prevented and reduced. Furthermore, even when the ink adheres on the discharge port surface, the ink can be sucked and removed and it is, therefore, possible to prevent the mixture of the ink inside the discharge port and maintain the recording quality of high quality.

It is preferable that supply path switching means for switching the supply path for supplying the ink to recording means is further provided.

Space forming means may contain angle correction means for correcting the angle of the cap and separating means for acting on the angle correction means to separate one end side of the cap from the discharge port surface. This constitution uses the angle correction means of the cap conventionally provided to allow the cap to adhere on the discharge port surface and it is, therefore, not necessary to provide a special mechanism as the gap forming means.

Recording means has a plurality of discharge port columns provided generally in parallel and discharges the ink of different color for each discharge port column, and the cap may collectively cover a plurality of discharge port columns in common.

A communication portion with the suction means of the cap is provided at the one end portion side in relation to the longitudinal direction of the discharge port columns, and it is preferable that the communication portion with the communication valve of the cap and the gap formed by the gap forming means are provided at the other end portion side in relation to the longitudinal direction of the discharge port columns. According to this constitution, the ink suction and the ink flow inside the cap due to flow-in of the atmosphere are generated in the longitudinal direction of the discharge port and it is, therefore, possible to prevent the ink from flowing into the direction to cross over each discharge port of the ink and mixing.

Still another object of the present invention is to provide the recovery method of the ink jet recording apparatus which discharges the ink from the discharge port provided on the discharge port surface of the recording means having a suction step of sucking the ink from the discharge port by the suction means in a state of the cap closely contacting the discharge port surface, a first exhaustion step of creating a gap between the cap and the discharge port surface and exhausting the ink inside the cap by the suction means and a second exhaustion step of putting the communication valve for communicating the inside of the cap with the atmosphere in a communication state, closely contacting the cap to the discharge port surface and exhausting the ink inside the cap by the suction means.

According to this constitution, flowing backward of the ink inside the cap to the inside of the discharge port and closely contacting the discharge port again of the ink sucked and mixed inside the cap can be prevented and reduced. Furthermore, even when the ink adheres on the discharge port surface, the ink can be sucked and removed and it is, therefore, possible to prevent the mixture of the ink inside the discharge port and maintain the recording quality of high quality.

It is preferable that the suction step has the suction means to perform the suction when the supply switching means, in which the cap adheres on the discharge port surface and switches the supply path of the ink to the recording means, is in a closed state and, after that, has the supply path switching means to be put in an open state.

It is preferable that the suction ability of the suction means is decreased substantially at the same time when the supply path switching means is put in an open state. According to this constitution, the negative pressure inside the cap is always maintained larger than the negative pressure inside the recording means so as to prevent the ink from flowing backward to the inside of the discharge port and, at the same time, the suction ability is decreased so as to reduce the differential pressure between the inside of the recording head and the atmosphere and it is, therefore, possible to prevent breakdown of meniscus of the discharge port, backward flow of the ink and mixture of the ink when the gap is created between the cap and the discharge port surface.

In the first exhaustion step, it is preferable that the suction ability of the suction means is increased substantially at the same time when the gap forming means forms a gap between the cap and the discharge port surface. According to this constitution, the suction time can be shorten and extra ink deposited on the discharge port surface can be quickly sucked and it is, therefore, possible to prevent mixture of the ink to the inside of the discharge port.

According to the present invention, flowing backward of the ink inside the cap to the inside of the discharge port and closely contacting the discharge port surface again of the ink sucked and mixed inside the cap can be prevented and reduced. Furthermore, even when the ink adheres on the discharge port surface, the ink can be sucked and removed and it is, therefore, possible to prevent mixture of the ink inside the discharge port and maintain the recording quality of high quality.

When the gap forming means contains the angle correction means for correcting the angel of the cap and the separating means for acting on the angle correction means to separate one end side of the cap from the discharge port surface, the angle correction means of the cap conventionally provided to allow the cap adhere on the discharge port surface is used and it is, therefore, not necessary to provide a special mechanism as the gap forming means and its constitution becomes simple.

When the communication portion with the suction means of the cap is provided at the one end portion side in relation to the longitudinal direction of the discharge port columns and the communication portion with the communication valve of the cap and the gap formed by the gap forming means are provided at the other end portion side in relation to the longitudinal direction of the discharge port columns, the flow inside the cap due to suction of the ink and flow-in of the atmosphere is generated in the longitudinal direction of the discharge port and it is, therefore, possible to prevent the ink from flowing in the direction to cross over each discharge port and mixing.

When the suction ability of the suction means is decreased substantially at the same time when the supply path switching means is put in an open state, the negative pressure inside the cap is always maintained larger than the negative pressure inside the recording means so as to prevent the ink from flowing backward to the inside of the discharge port and, at the same time, the suction ability is decreased so as to reduce the differential pressure between the inside of the recording head and the atmosphere and it is, therefore, possible to prevent breakdown of meniscus of the discharge port, backward flow of the ink and mixture of the ink when a gap is created between the cap and the discharge port surface.

In the first exhaustion step, when the suction ability of the suction means is increased substantially at the same time when the gap forming means forms a gap between the cap and the discharge port surface, the suction time can be shorten and, at the same time, extra ink deposited on the discharge port surface can be quickly sucked and it is, therefore, possible to prevent mixture of the ink to the inside of the discharge port.

DESCRIPTION OF THE PREFERRED EMBODIMENTS

Figure 1:
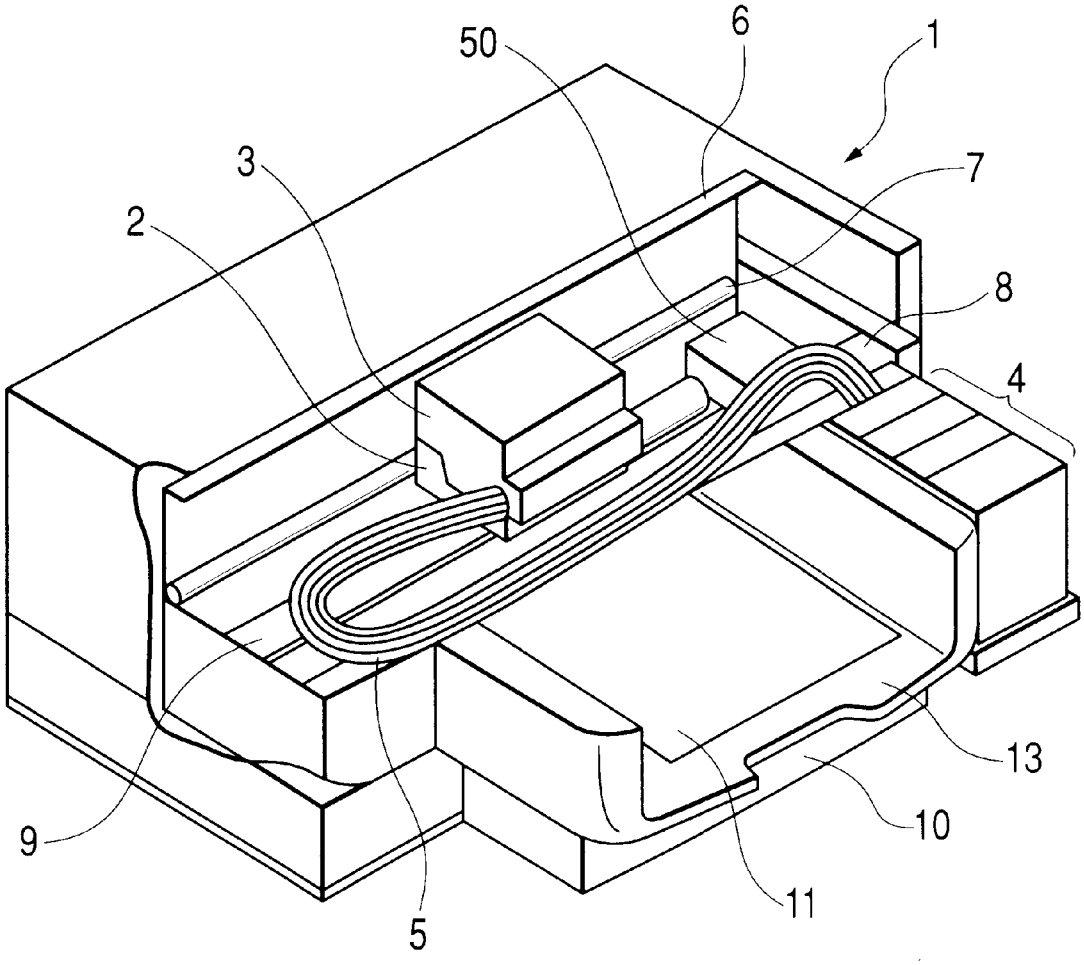
FIG. 1 is an overall schematic perspective view of an ink jet apparatus of one embodiment of the present invention.

Hereinafter, embodiments of the present invention will be described with reference to the drawings. It is to be noted that the same reference numerals throughout each drawing shall show the same or corresponding components.

FIG. 1 is an overall schematic diagram showing an ink jet recording apparatus of the first embodiment of the present invention. In the ink jet recording apparatus 1 shown in FIG. 1, a recording head 3 which is recording means has a plurality of discharge port columns of such a direction as to cross (generally orthogonal to) the scanning direction on the surface opposite to a recording paper 11 which is one example of a recording medium, and discharges different color of ink for each discharge port. The recording head 3 is supplied with the ink of each color respectively for each discharge port column from an ink tank 4 through respective supply tubes 5.

Figure 12:
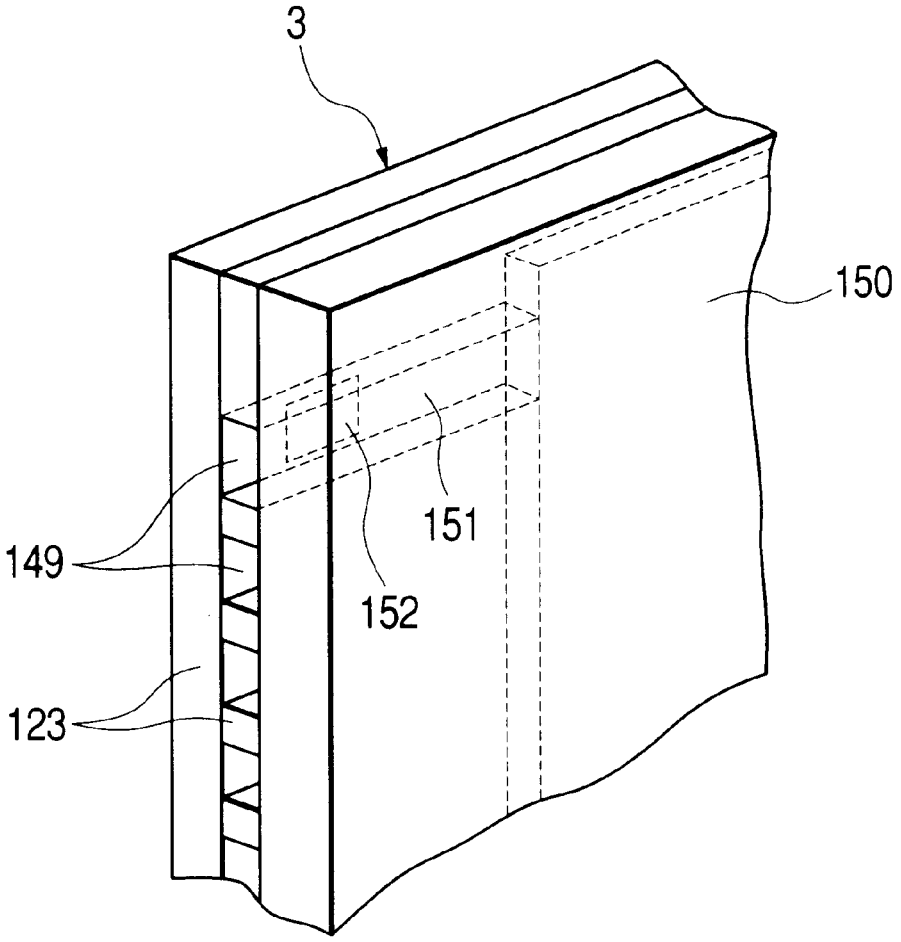
FIG. 12 is a partial perspective view typically showing a structure of an ink discharge portion of the recording head.

FIG. 12 is a partial perspective view schematically showing the structure of an ink discharge portion (one discharge port column) of the recording means (recording head) 3. In FIG. 12, a plurality of discharge ports 149 are formed in a predetermined pitch on an discharge port surface 123 facing with the recording medium such as recording paper placed at a predetermined gap (for example, about 0.3 to 0.32 mm), and an electrothermal converter (heating resistor) 152 for generating energy for use of ink discharge is provided along the wall surface of each liquid path 151 which communicates a common liquid chamber 150 and each discharge port 149. The recording head 3 is guided and supported by such a positional relation as to line up in a direction where the above described discharge port 149 crosses the scanning direction (moving direction of the carrier in the present embodiment which is mounted on the carrier). In this way, the recording means (recording head) 3 is constituted, wherein, by driving (applying a pulse voltage to) the electrothermal converter 152, which acts on the basis of an image signal or an discharge signal, the ink inside the liquid path 151 is subjected to a film boiling and, by the pressure generated at that time, the ink is discharged from the discharge port 149.

The recording head 3 is mounted on the carrier 2, and the carrier 2 is fixed to a frame 6 at both end portions and is slidingly supported along a guide shaft 7 and a guide rail 8 which are mutually arranged in parallel. Note that this carrier 2 is allowed to make reciprocating movement by a belt driving device and a motor, which are not shown.

In the vicinity of the moving range of the carrier 2, a conveying roller 9 and a pinch roller (not shown), which abuts against this roller, are provided. In the front portion of this ink jet recording apparatus 1, a cassette 10 detachably attachable to the frame 6 is attached. The recording paper 11 is supplied from the cassette 10 and proceeds to a recording position opposite to the recording head 3 and, in a state held between the conveying roller 9 and the pinch roller and by rotation of the conveying roller 9 and the pinch roller, is conveyed to a direction substantially vertical (sub scanning direction) to the moving direction of the carrier 2 (main scanning direction) and, after the completion of the recording, is discharged to a delivery stacker 13.

In a home position provided in the vicinity of one end portion of the moving range of the carrier 2, a head recovery means 50 is provided in a position able to oppose to the recording head 3. The head recovery means 50, while standing by, acts before and after recording operations or at recording intervals of every one line and performs operations such as capping, suction, wiping and the like to maintain a function such as to prevent clogging of the recording head 3. Next, this recovery means 50 will be described in details by using FIGS. 2, 3 and 4.

Figure 2:
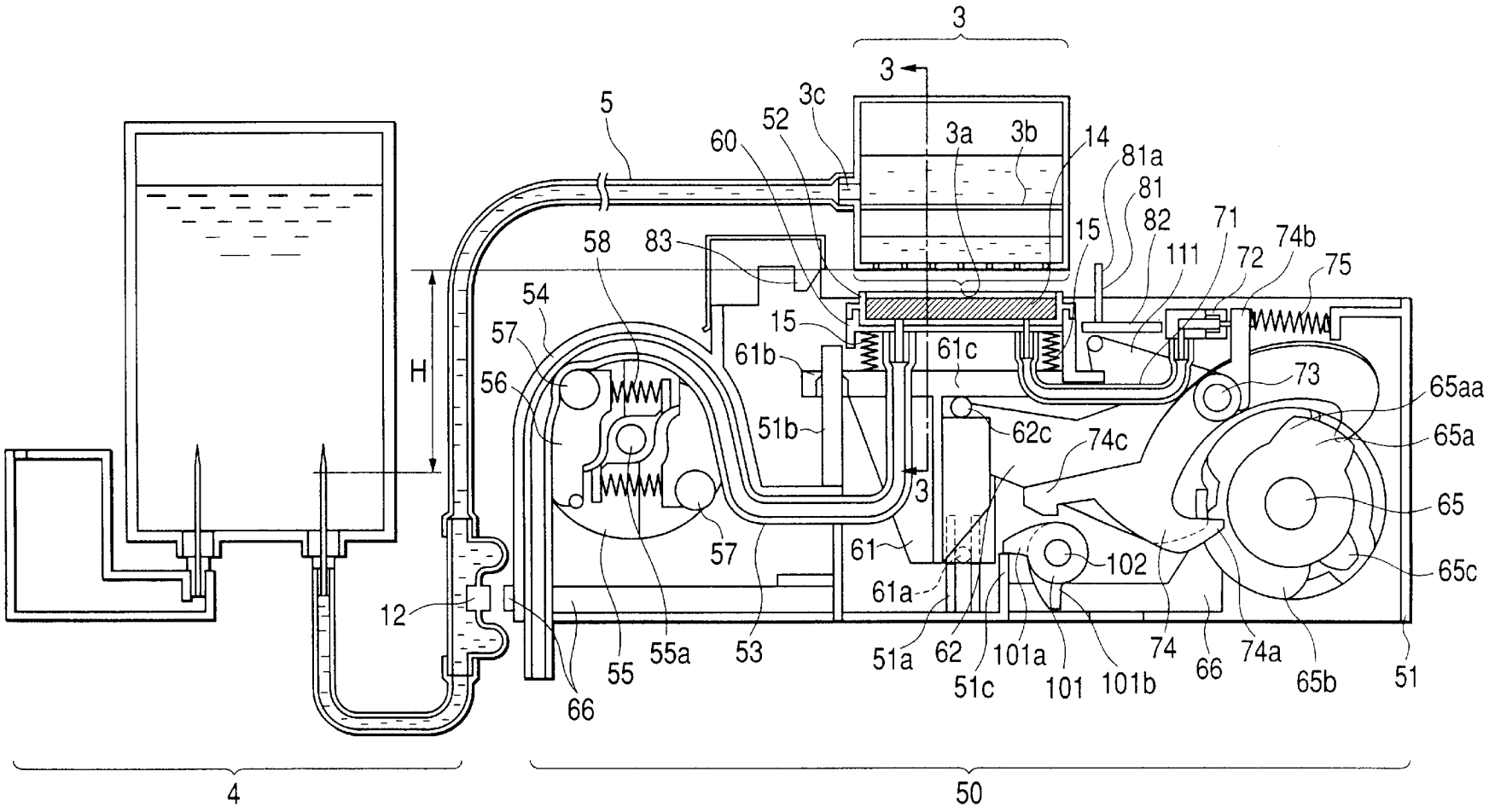
FIG. 2 is a schematic sectional view showing head recovery means and a constitution in the vicinity of a cam and its operation of the ink jet recording apparatus shown in FIG. 1.

FIG. 2 is a schematic sectional view showing the constitution and the operation in the periphery of the head recovery means 50 and the cam of the present embodiment and illustrates essential components only, which are necessary for the description of the present invention.

Figure 3:
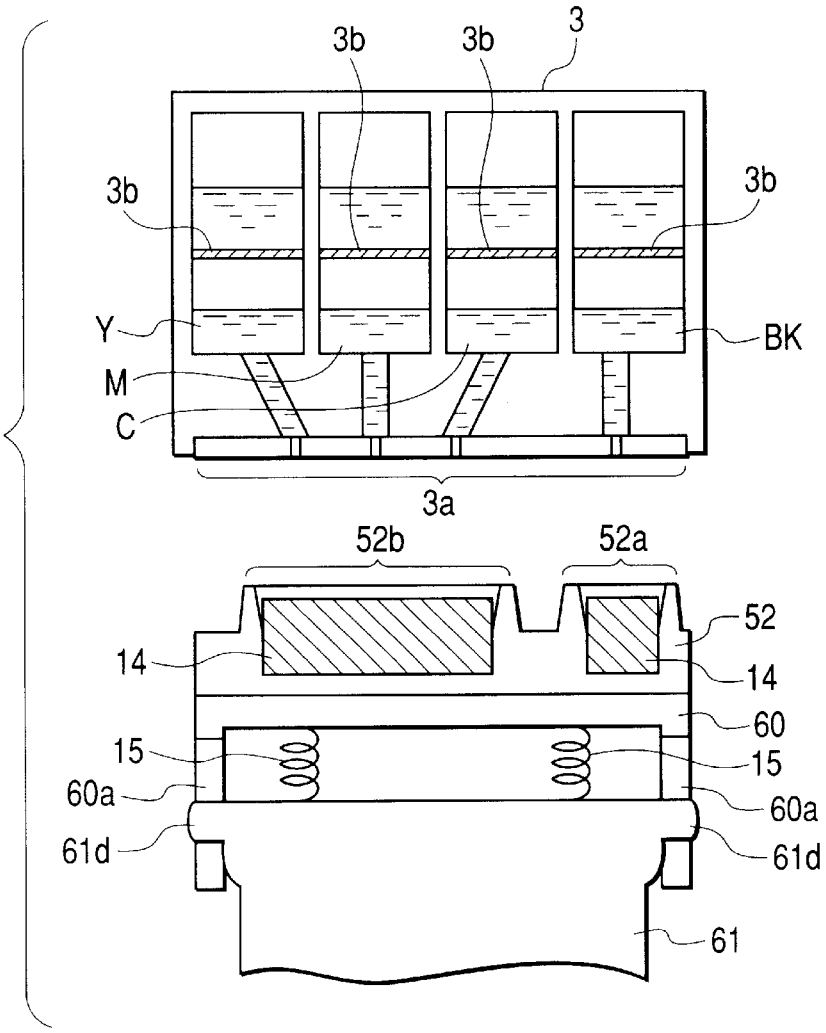
FIG. 3 is a sectional view cut along the 3—3 line in FIG. 2.

The recording head 3 has an discharge port surface 3*a* where the discharge port columns discharging the ink are provided, and is scanned integrally with the carrier 2 in a direction orthogonal to the sheet of FIG. 3 (main scanning direction). The head recovery means 50 has cap means 52 which is provided in a position opposing to the discharge port surface 3*a* of the recording head 3 when the carrier 2 moves to the home position.

The constitutions of the recording head 3 and the cap means 52 will be described with reference to FIG. 3. FIG. 3 is a sectional view cut along the 3—3 line in FIG. 2, and the recording head 3 has a representative constitution in a color ink jet recording apparatus and its inside is divided into ink chambers of black (Bk), cyan (C), magenta (M), yellow (Y).

Each chamber is attached with a filter 3*b* to prevent contaminants from approaching so as not to clog the discharge port and, in a gap below and above the filter 3*b*, an ink layer and an air layer are formed, respectively.

The discharge port columns of cyan (C), magenta (M), yellow (Y) reduce the distance among each discharge port as much as possible for the purpose of miniaturization of the apparatus, improvement of impact accuracy of the ink on the recording paper and reduction of recording time by reduction of moving distance of the carrier, and the discharge port column of black (Bk) is located slightly away in contrast to the discharge ports of other colors.

The cap means 52 forms a cap 52*a* for Bk and a cap 52*b* for (C, M, Y) and, by suction selection to be described later, the discharge port columns having difference in usage frequency are separately recovered by suction so that the discharged amount of ink can be reduced. The cap means 52 is integrally formed on the upper surface of a cap base 60, and the inside of each cap 52*a*, 52*b* is provided with an absorber 14. The cap base 60 is provided with a claw 60*a* having an attachment hole and, by the attachment hole being engaged with a boss 61*a* provided in a cap holder 61, the cap base 60 is oscillationally attached and energized upward by a cap spring 15.

As shown in FIG. 2, each ink chamber of the recording head 3 has an ink supply port 3*c*, and each color port is connected to a supply tube 5 and an ink tank 4, respectively.

The ink tank 4 is constituted and arranged in such a manner as to have a predetermined water head difference H for the recording head 3 so that the recording ink does not drop at other than print driving time and, when the ink inside the recording head is reduced due to discharge and suction, the ink is automatically supplied from the supply tube 5 by the negative pressure inside the recording head 3. The supply path including the supply tube 5 is provided with supply switching means such as a valve 12 to make it possible to switch the supply path.

The recovery base 51 supports and fixes each component part of the head recovery means 50 for the recording head 3, the valve 12 and the like.

The cap 52*a* for Bk and the cap 52*b* for colors (C, M, Y) of the cap means 52 are provided with communication means in a position spaced away to the right side of FIG. 2 from the center of the longitudinal direction of discharge port columns. That is, to this position, atmospheric communication tubes 71 are attached, and one end each thereof is connected to respective atmospheric communication valves 72.

The cap 52*a*, 52*b* are provided with suction means at a position spaced away to the left position of FIG. 2 from the center of the longitudinal direction of the discharge port columns. That is, to this position, a suction tube 53 into which the ink and the like can flow is attached, and this tube 53 extends through a tube frame 54 and a pump frame 55. Note that, in FIG. 2, the constitution in the periphery of the cap 52*a* for Bk and the cap 52*b* for color is shown in the same sectional view for either one. The pump frame 55 is shaft-strutted by a pump roller holder 56 and, above the pump roller holder 56, a pump roller 57 which projects outward is provided in two pieces individually for Bk and for color and, in a symmetric position with the pump frame rotational shaft 55*a* as a center, the pump roller 57 is similarly provided in two pieces for Bk and for color. A pump spring 58 energizes the pump rollers 57, respectively in such a direction to press outward (the tube frame 54 side). The tube 53, the tube frame 54, the pump frame 55, the pump roller holder 56 and the pump rollers 57 constitute the tube pump 59.

A cam 65 is rotatably shaft-strutted on one side of the recovery base 51. The cam 65 is integrally formed with a first cam plate 65*a*, a second cam plate 65*b*, a third cam plate 65*c*, a fourth cam plate 65*d* (see FIG. 7) and a fifth cam plate (not shown), which are necessary for the operation of the head recovery means 50. Note that the number of cam plates is not limited to five pieces.

Two pieces of the atmosphere communication arms 74 for Bk and for color, a cap arm 62 and a half opening arm 111 are shaft-strutted on a shaft 73, which is fixed on the recovery base 51. Two pieces of the atmosphere communication springs 75 are provided in such a manner as to energize two pieces of the atmosphere communication arms 74 counterclockwise, respectively, and the atmosphere communication valves 72 for Bk and for color are maintained in a sealed state, respectively. When the first cam plate 65*a* rotates, two pieces of the atmosphere communication arms 74 oscillate at the same time by following a projecting portion 65*aa* of the first cam plate 65*a*. Then, by the operation of the valve arm 74*b* formed at the other end of the atmosphere communication arm 74, the switching of two pieces of the atmosphere communication valves 72 are performed at the same time.

The cap holder 61 is slidingly supported upward and downward with its guide portion 61*a* engaged with a slide rib 51*a* of the recovery base 51 and a guide hole 61*b* engaged with a slide shaft 51*b*. The cap arm 62 is oscillationally supported by the shaft 73. Cam follower portions 62*a* and 62*b* of the cap arm 62 oscillate by following rotations of the second cam plate 65*b* and the third cam plate 65*c*. A cap driving roller 62*c* is formed on the other end of the cap arm 62 and is engaged with a grove portion 61*c* of the cap holder 61 and slides upward and downward accompanied with oscillation of the cap arm 62.

A wiper blade 81 is made of a flexible material such as urethane and is fixed and supported by a wiper holder 82. The wiper holder 82 is slidingly supported leftward and rightward at the portion not shown for the recovery base 51. By following the movement of the wiper blade 81, a wiper cleaner 83 contacts its tip end portion 81*a* so as to perform the cleaning of the wiper blade 81.

A valve shaft 66 is slidingly supported leftward and rightward at the portion not shown for the recovery base 51, and switches the valve 12 by a fifth cam plate not shown.

A selection cam 101 is provided with cam portions 101*a*, 101*b*. The selection cam 101 rotates with a shaft 102 as a center, and is energized in such a manner as to rotate counterclockwise by a spring at the portion not shown, and is stopped by the cam portion 101*a* abutting against a stopper 51*c* provided in the recovery base 51. By the selection operation to be described later, an atmosphere communication state of the atmosphere communication valves 72 for Bk and for color can be selected by selectively oscillating two pieces of the atmosphere communication arms 74.

Figure 4:
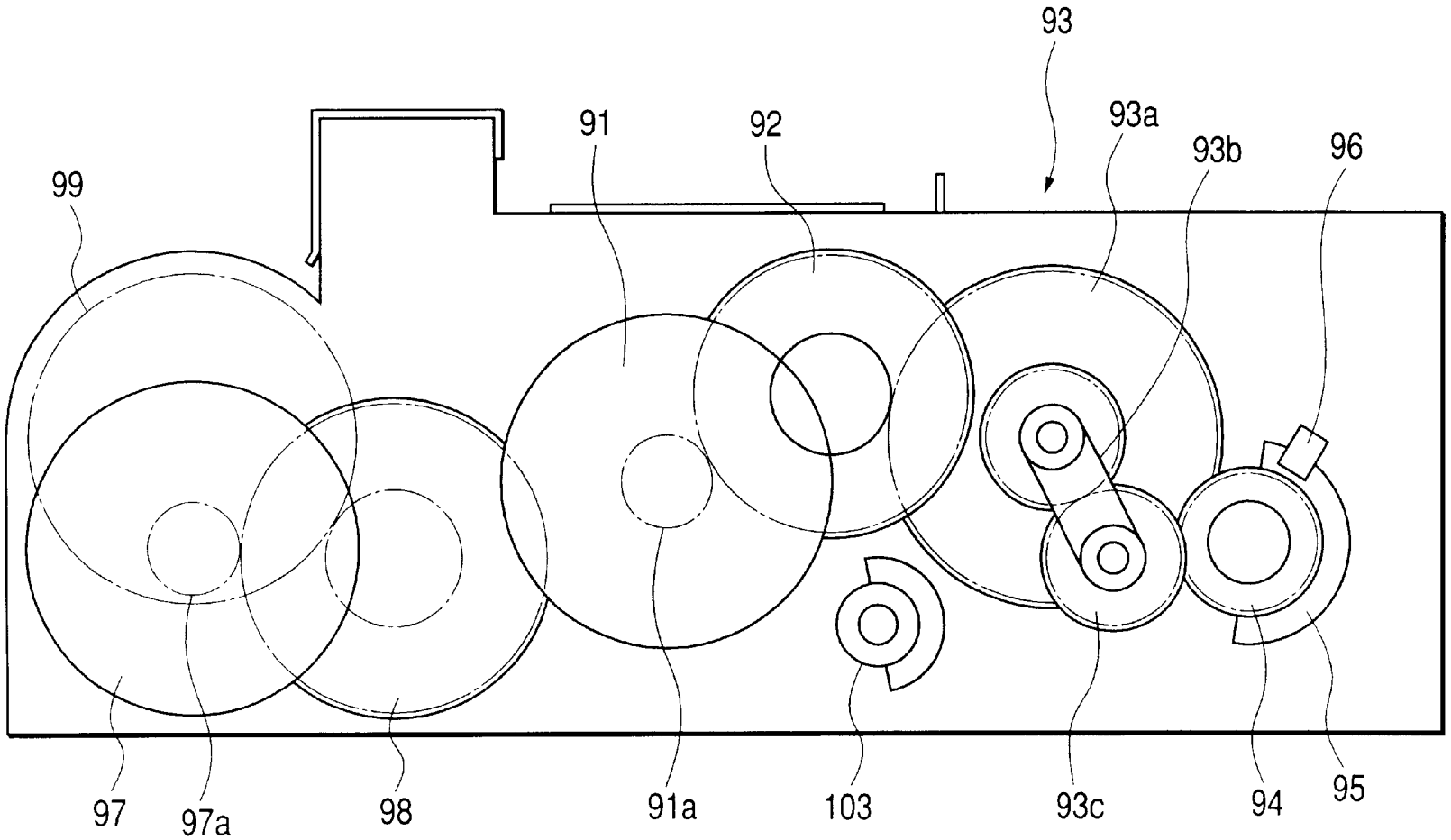
FIG. 4 is a schematic diagram showing a driving portion of the head recovery means.

FIG. 4 is a view illustrating the driving portion of the head recovery means 50, and is a drawing seen from the front side of FIG. 2. As shown in FIG. 4, a stepping motor 91, which is a driving source, is attached to the head recovery means 50, and a pinion gear 91*a* of this stepping motor 91 is connected to a pendulum type gear transmission mechanism 93 through a reducing gear 92. This pendulum type gear transmission mechanism 93 comprises a base gear 93*a*, which is connected to the reducing gear 92, a pendulum arm 93*b*, which is oscillationally attached to the base gear 93*a*, and a planetary gear 93*c*, which is attached to the tip end of the pendulum arm 93*b*.

The planetary gear 93*c* engages with a cam gear 94 when it is positioned at the right side of FIG. 4 as illustrated. The cam gear 94 and the above described cam 65 integrally rotate. On the outer periphery of the cam gear 94, a cam gear flag 95 is provided. This cam gear flag 95 is shielding plate for shielding a light from an optical sensor 96 and, by detecting whether the light is shielded or not, an optical sensor 96 can learn the phase of the cam gear 94.

When the stepping motor 91 normally rotates (rotates counterclockwise in FIG. 4), the reducing gear 92 and the base gear 93*a* of the pendulum type gear transmission mechanism 93 rotate by interlocking with each other, and the pendulum arm 93*b* inclines toward the right side of FIG. 4 as illustrated, and the planetary gear 93*c* engages with the cam gear 94. In this way, the cam gear 94 rotates counterclockwise. At this time, the first, fifth cam plates, which are integrated with the cam 65, also integrally rotate counterclockwise.

When the stepping motor 91 reversibly rotates (rotates clockwise in FIG. 4), the reducing gear 92 and the base gear 93*a* rotate by interlocking with each other, and the pendulum arm 93*b* inclines toward the left side of FIG. 4, and the planetary gear 93*c* engages with the selection gear 103 to allow the selection cam 101 integrally connected to the selection gear 103 to rotate.

The pendulum type transmission mechanism 93 is a one-way drive transmission means, by which the cam gear 94 is driven counterclockwise when the stepping motor 91 normally rotates and the selection cam 101 is driven clockwise when the stepping motor 91 reversibly rotates.

The head recovery means 50 is attached with a stepping motor 97, which is another driving source, and the pinion gear 97*a* of this stepping motor 97 is connected to a pump gear 99 through the reducing gear 98. The above described pump gear 59 integrally rotates with the pump gear 99.

When the stepping motor 97 normally rotates (rotates counterclockwise in FIG. 4), the reducing gear 98 and the pump gear 99 rotate by interlocking with each other. In this way, when the pump frame 55 rotates counterclockwise, the pump roller 57 moves, while squeezing the suction tube 53 between itself and the tube frame 54. This operation sucks the inside of the cap means 52 and the pressure of the inside becomes lower than the atmosphere. Accompanied with this operation, high viscosity ink and minute contaminants in the inside of discharge port of the recording head 3 as well as bubbles in the ink liquid are sucked out, and it is possible to prevent the printing failure due to clogging and the like and recover the printing capacity of the recording head 3.

The above described FIG. 2 shows a state of the head recovery means 50 during recording operations. The cap means 52 stands by in a position spaced away by a predetermined amount to the discharge port surface 3*a*, and the recording head 3 can freely move above the cap means 52. In order to maintain a steady discharge, the recording head 3 discharges the small amount of ink to the inside of the cap means 52 immediately before recording. When the predetermined amount of ink gathers inside the cap means 52, the pump is operated, and the ink inside the cap means 52 is discharged so as to prevent the ink from overflowing. When the ink is discharged from the discharge port of the recording head 3, the ink inside the recording head 3 is reduced. The reduced amount of ink is supplemented from the ink tank 4 through the supply tube 5 by negative pressure inside the recording head 3 so as to maintain the necessary liquid surface height before the print recording.

The ink liquid surface height recovery operation inside the recording head 3 and color-mixing prevention of the ink which is the object of the present invention in the head recovery means 50 of the presenting embodiment having the above described schematic structure will be described with reference to FIGS. 5 to 9.

Figure 5:
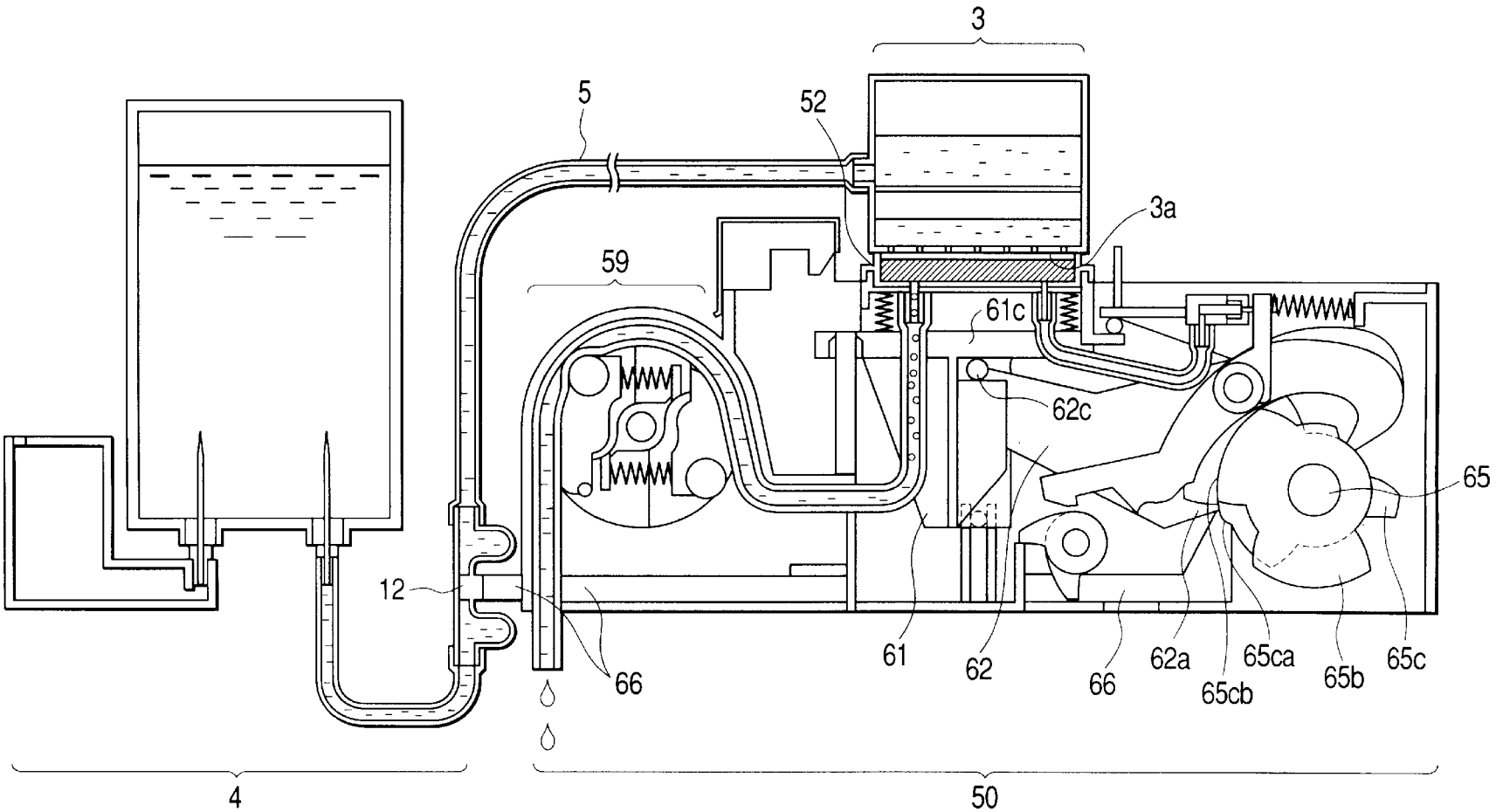
FIG. 5 is an operation view showing a state in which a recording head being put in a predetermined negative pressure state.

FIG. 5 is an operation view showing a state in which the inside of the recording head 3 is put into a predetermined negative pressure. In order to recover the decreased ink liquid surface inside the recording head 3, the stepping motor 91 is normally rotated for a predetermined amount, and the cam 65 is rotated. By following the rotation of the second cam plate 65*b* and the third cam plate 65*c*, when the cam follower portion 62*a* traces from an inclined surface 65*ca* of the third cal plate 65*c* to the outer peripheral surface 65*cb* and the cap arm 62 oscillates, the cap base 61 slides upward. Then, the cap means 52 abuts against the recording head 3 so as to put the discharge port surface 3*a* of the recording head 3 into a sealed state. Then, the action of a plurality of cap springs 15 and a cap base 60 and the like correct the cap means 52 in its angle so as to generally adhere to the discharge port surface 3*a* of the recording head 3. Such a mechanism is referred to as angle correction means.

The fifth cam plate not shown pushes a valve plate 66 leftward and closes the valve 12 and puts the supply tube 5 into a closed state. By operating the pump 59 in this closed state, the ink is sucked out from the discharge port of the recording head 3 and, further, the air gathered inside the recording head 3 is sucked out from the discharge port so that the inside of the recording head 3 is put into a predetermined negative pressure.

Figure 6:
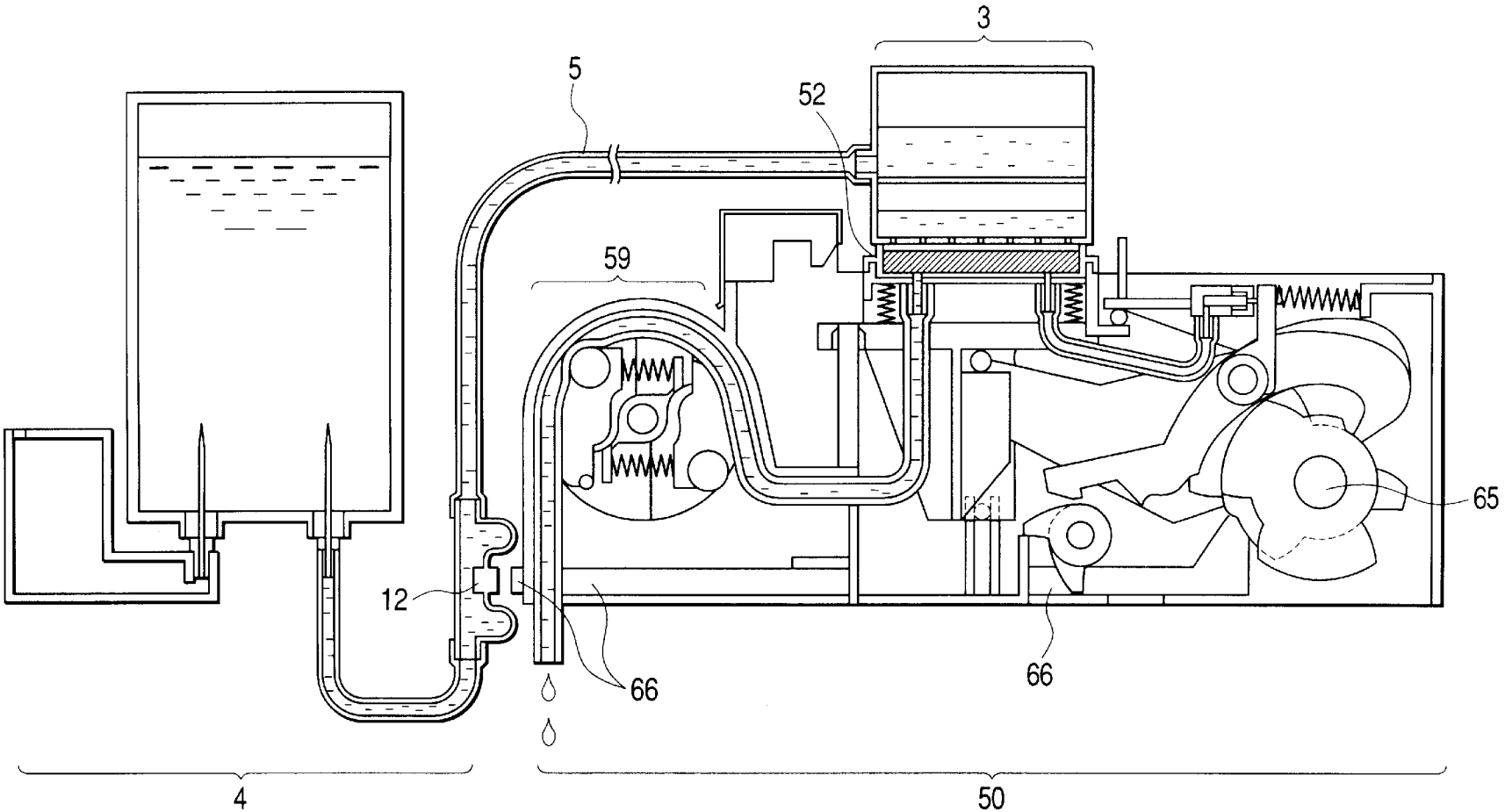
FIG. 6 is an operation view showing a state in which an ink liquid surface height inside the recording head being put into a recovered state.

FIG. 6 shows a state in which the ink liquid surface height inside the recording head 3 has recovered. In FIG. 5, when the cam 65 is rotated for a predetermined amount after a predetermined negative pressure is generated inside the recording head 3, the valve shaft 66 is pulled back by the fifth cam plate not shown, and the valve 12 is opened, and the ink is filled through the supply tube 5 by the ink tank 4 by the negative pressure inside the recording head 3, and the height of the ink liquid surface is recovered.

When the valve 12 is opened, substantially at the same time, the suction amount is reduced by decreasing the rotational speed of the tube pump 59 or allowing the pump to intermittently rotate. In this way, the negative pressure is generated inside the cap 52 and it is possible to prevent the ink flowing back from the discharge port and reduce the discharged amount of ink.

Figure 7:
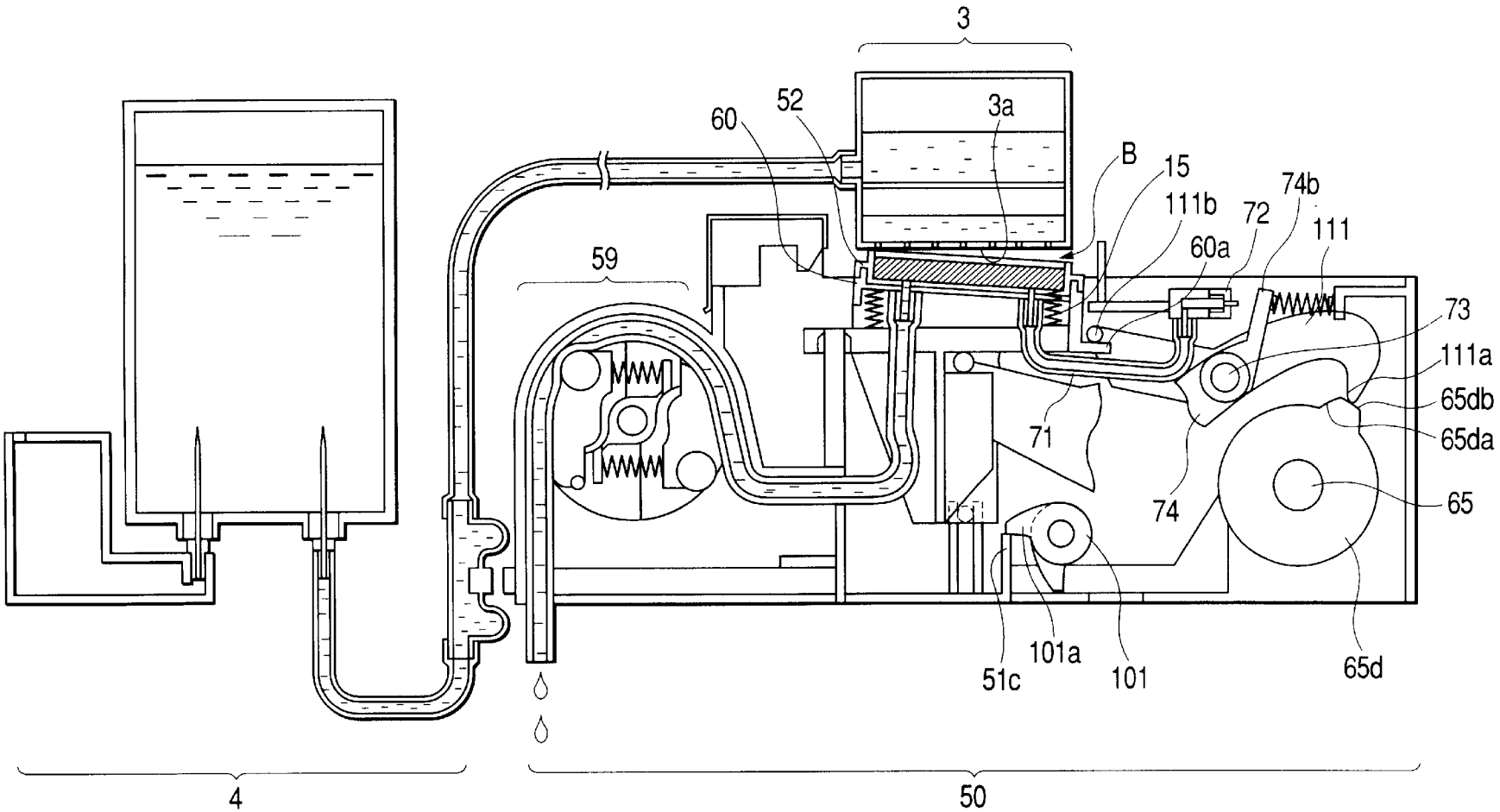
FIG. 7 is an operation view showing a state in which a cap is half-opened and subsequently an atmosphere communication valve is opened.

FIG. 7 is an operation view showing a half opening of the cap and subsequently a state in which the atmosphere communication valve 72 is opened. In FIG. 6, the sucked ink is filled inside the cap means 52. In particular, each color is mixed inside the cap 52*b* for color, and when the atmosphere communication valve 72 is opened in this state, the air flows into the inside of the cap means 52 through the atmosphere communication tube 71, and the ink inside cap means 52 emits toward the discharge port surface 3*a* so that the ink flows back to the inside of the discharge port and colors of the ink mixes.

As a countermeasure, one side of the cap means 52 is liberated so as to form a gap. When the cam 65 is rotated for a predetermined amount, by following the rotation of the fourth cam plate 65*d*, a cam follower portion 111*a* of a half-opening arm 111 traces from an inclined surface 65*da* of the fourth cam plate 65*d* to an outer peripheral surface 65*db* and the half-opening arm 111 oscillates with the shaft 73 as a center, and a depressing portion 111*b* abuts against a bumping portion 60*a* of the cap base 60 so that the cap base 60 bends the cap spring 15 and oscillates it counterclockwise. By this operation, the right side of the cap means 52 separates from the discharge port surface 3*a* of the recording head 3. That is, the half-opening arm 111 and the like act on the cap base 60 and cap spring 15, and separates the end portion of the cap means 52 from the discharge port surface 3*a*. Such a mechanism is referred to as gap forming means.

Since a cap half-opening mechanism (gap forming means) uses cap angle correction means to allow the cap means 52 and the discharge port surface 3*a* to adhere with each other, it is not necessary to provide a special mechanism in the vicinity of the cap means 52, and a cost-up can be reduced.

The cap means 52 is half-opened and, substantially at the same time, the rotational speed of the tube pump 59 is increased so that the suction speed is increased. The ink filled inside the cap means 52 does not blow upon the discharge port surface 3*a* since the air flows-in from the direction of the arrow mark B, and is sucked together with the ink deposited on the discharge port surface 3*a* from the right side of FIG. 7.

After the cap is half-opened and when the cam 65 is further rotated, the first cam plate 65*a* rotates, and the atmosphere communication arm 74 oscillates by following the inclined surface 65*ab* of the projecting portion 65*aa* of the first cam plate 65*a*. When the cam 65 rotates until a phase in which a cum follower 74*a* abuts against an outer peripheral surface 65*ac* of the first cam plate 65*a*, a valve arm 74*b* formed on the other end of the atmosphere communication arm 74 separates from the atmosphere communication valve 72, and the atmosphere communication valve 72 is put into an open state (see FIG. 8).

Figure 8:
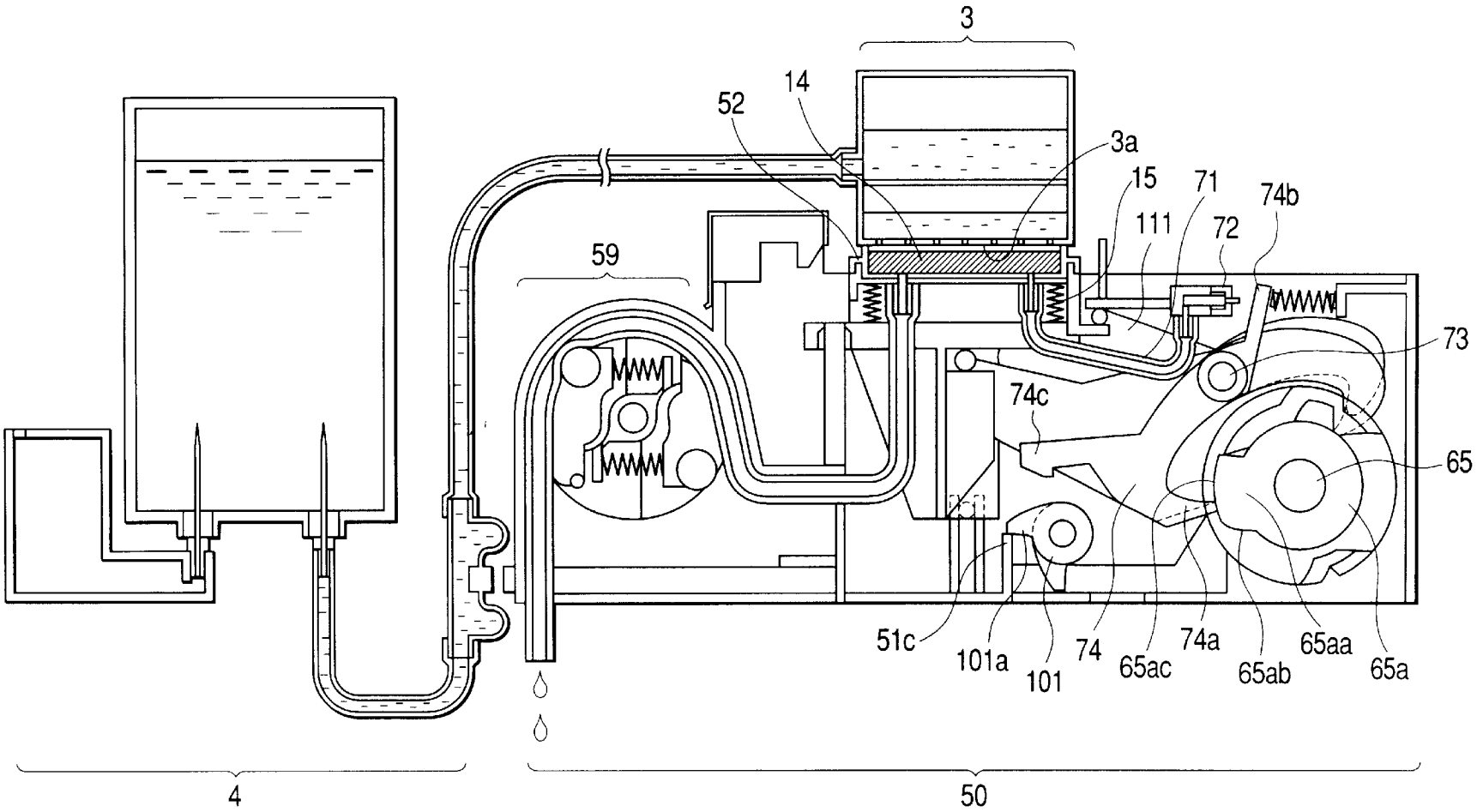
FIG. 8 is an operation view showing an empty suction state.

FIG. 8 is an operation view showing an empty sucking state. When the cam 65 is rotated for a predetermined amount, while the atmosphere communication valve 72 is kept remaining in an open state, the half-opening arm 111 rotates counterclockwise, and the cap means 52 adheres again on the discharge port surface 3*a* by energizing force of the cap spring 15. During this time, the tube pump 59 continues to drive so that the air flows to the inside of the cap means 52 from the atmosphere communication valve 72 through the atmosphere communication tube 71, and it is, therefore, possible to cleanly suck the small amount of ink which flowed the inside of the atmosphere communication tube 71 and the ink inside the cap at the suction time. It is also possible to suck the ink deposited on the discharge port surface 3*a* which was not sucked completely by half-opening of the cap because the gap between the discharge port surface 3*a* and the absorber 14 was minute. By the above described half-opening of the cap and empty suction operation, the ink suction and the air flow forms a flow of ink in the longitudinal direction of the discharge port column and it is, therefore, difficult for each color of ink to flow to the other discharge port column.

Figure 9:
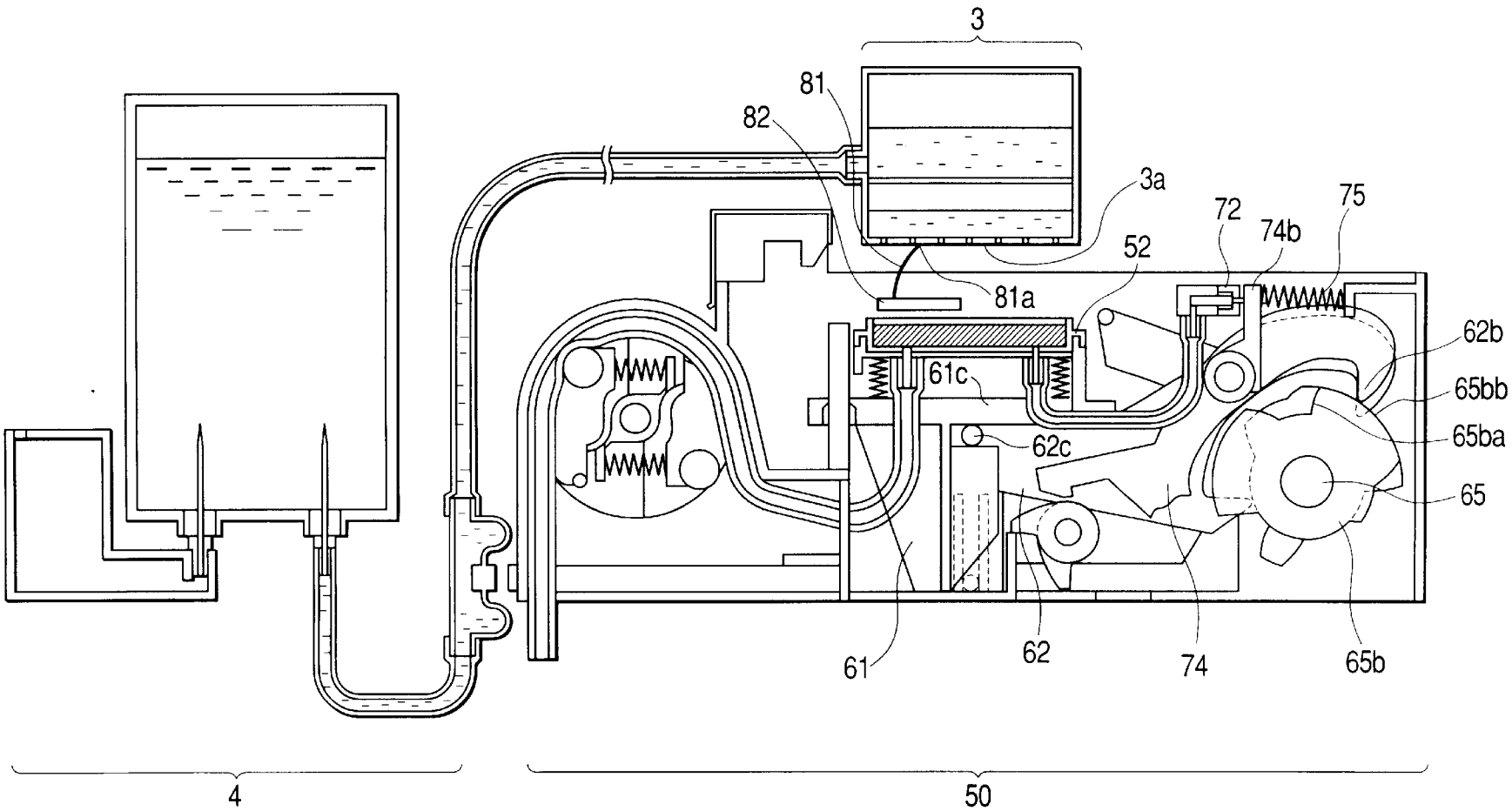
FIG. 9 is an operation view showing wiping of the head.

FIG. 9 is an operation view showing wiping of the recording head 3. By following the rotation of the second cam plate 65*b* and the third cam plate 75*c*, when the cam follower 62*b* traces from the inclined surface 65*ba* to the outer peripheral surface 76*bb* and the cap arm 62 oscillates, the cap base 61 slides downward from FIG. 9. Next, in this state, the wiper blade 81 is moved to the left side of FIG. 9 by driving means not shown. By following this operation, the top end portion 81*a* traces the discharge port surface 3*a* and performs a cleaning of the recording head 3. At this time, by the cap half-opening operation shown in FIG. 7 and the empty suction operation shown in FIG. 8, the color-mixture by wiping can be controlled since the ink deposited on the discharge port surface 3*a* is in a small quantity. After the wiping is completed, the cam 65 is rotated and restored to the state of FIG. 2.

The above is one cycle of the cam 65. After this, by pre-discharging the ink mixed in a minute quantity to the inside of the cap 52, the color mixture can be prevented. By the manner as described above, the recovery operation of the ink liquid surface height can be completed.

When the usual suction recovery of the recording head 3 is performed, the cam 65 is rotated until it reaches the state of FIG. 6, and the tube pump 59 is driven from a state of the valve 12 being opened and, after that, the operations shown in FIGS. 7 to 9 are performed. In this way, the color mixture can be prevented even in the usual suction recovery.

Figure 10:
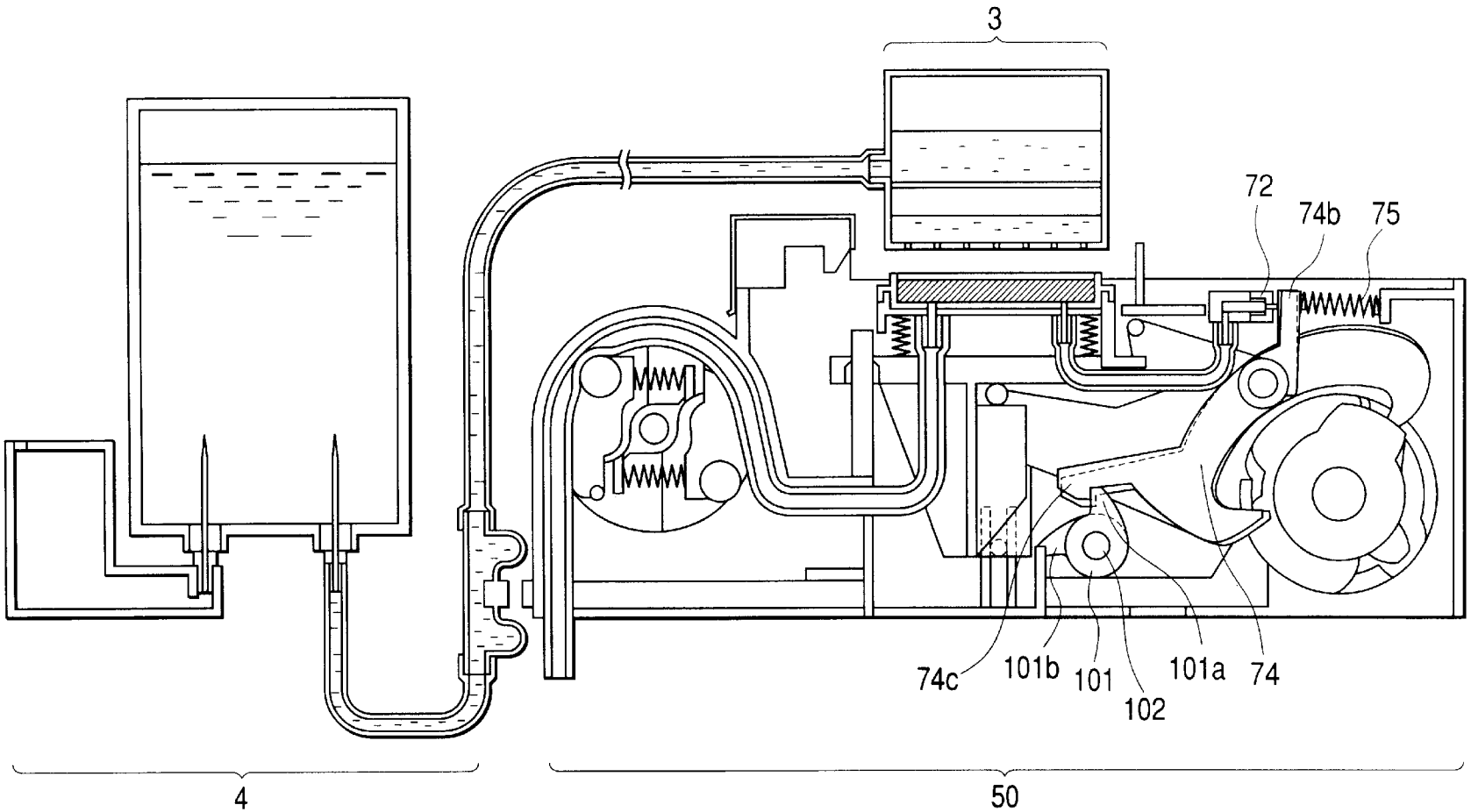
FIG. 10 is an operation view showing a n atmosphere released state of the atmosphere communication valve for use of color.
Figure 11:
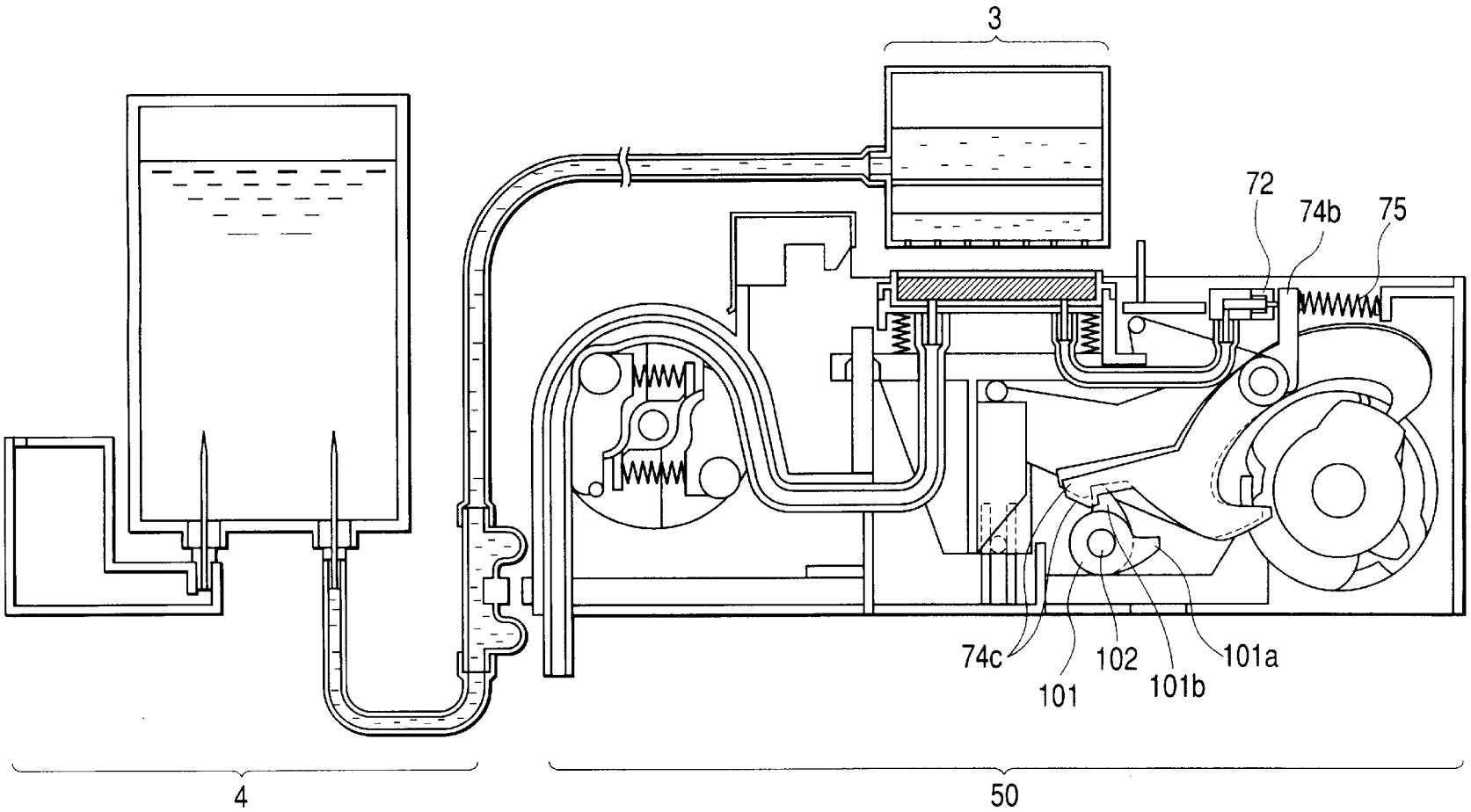
FIG. 11 is an operation view showing an atmosphere released state of the atmosphere communication valve for use of black.

FIGS. 10 and 11 show the release selection operation of the atmosphere communication valve 72. When the head recovery means 50 is in a state of capable of recording (in a state of FIG. 2) and the stepping motor 91 is reversibly rotated as described by using FIG. 4, the selection cam rotates clockwise.

FIG. 10 shows an atmosphere released state of the atmosphere communication valve 74 for color. When the cam portion 110*a* rotates for a predetermined amount, it pushes upward the cam follower 74*c* of the frontal atmosphere communication arm 74 (for color) and climbs over a claw portion of the cam follower 74*c*. After that, when the stepping motor 91 is normally rotated to perform the recovery operation of the ink liquid surface height and the normal recovery operation, the planetary gear 93*c* rotates clockwise, and the selection gear 103 integrated with the selection cam 101 rotates counterclockwise by interlocking with the planetary gear 93*c*. When the cam portion 101*a* engages with the claw portion of the cam follower 74*c*, the selection gear 103 stops rotating so that the planetary gear 93*c* separates from the selection gear 103 and engages with the cam gear 95 and executes the recovery operation. At this time, the valve arm 74*b* of the frontal atmosphere communication arm 74 (for color) separates from the frontal atmosphere communication valve 72 (for color) and is put into an atmosphere communicated state and, therefore, during sucking operation, the cap 52*b* for color is put into a empty sucking state and the cap 52*a* for Bk only can be sucked.

FIG. 11 shows the atmosphere released state of the atmosphere communication valve 74 for Bk. Similarly to the above described, when the selection cam 101 is rotated and is rotated further more than the state of FIG. 10, the cam portion 101*a* separates from the cam follower 74*c*, and the atmosphere communication arm 74 for color oscillates counterclockwise by the atmosphere communication spring 75, and the valve arm 74*b* for color closes the atmosphere valve 72 for color. When the selection cam 101 further rotates, the cam portion 101*b* climbs over the claw portion of the cam follower 74*c* of the inner atmosphere communication arm 74(for Bk). After that, when the same recovery operation is performed, the cap 52*b* for color only can be sucked.

As described above, even when the cam portions 101*a*, 101*b* rotate a little too far than the state of engaging with the claw portion of the cam follower 74*c* by rotation of the selection cam 101, since the selection gear 103 is energized to a counterclockwise direction by the spring, when moving to the recovery operation, the planetary gear 93*c* cannot separate from the selection gear 103 until the cam portions 101*a*, 101*b* engage with the claw portion of the cam follower 74*c*, and can reliably select the releasing of the atmosphere communication valve without detecting the position by the sensor and the like.

After the suction operation is completed, by the atmosphere communicating operation to push upward the cam follower 74*a* by the first cam plate 65*a* as shown in FIGS. 7 and 8, the cam portions 101*a*, 101*b* are disengaged from the claw portion of the cam follower 74*c*, and the cam portion 101*a* collides against a stop bar 51*c* by the energizing force of the spring. That is, even when the release selection of the atmosphere communication valve is performed, the initial state can be restored every time the recovery operation is completed.

What is claimed is:

1. An ink jet recording apparatus which discharges ink from a discharge port provided in the discharge port surface of recording means comprising:

a cap closely contacting said discharge port and covering said discharge port;

sucking means for sucking ink from said discharge port through said cap closely contacted said discharge port;

gap forming means for partially generating a gap between said cap and said discharge port surface;

a communication valve for communicating the inside of said cap with atmosphere.

2. The ink jet recording apparatus according to claim 1, wherein said gap forming means forms a gap between said cap and said discharge port surface after said sucking means performs sucking ink from said discharge port with said cap being in a state of being closely contacted said discharge port surface, wherein said communication valve is put into a communication state after the gap is formed between said cap and said discharge port surface by said gap forming means.

3. The ink jet recording apparatus according to claim 1, further comprising supply path switching means for switching supply paths which supply the ink to said recording means.

4. The ink jet recording means according to claim 3, wherein, when said cap adheres on said discharge port surface and said supply path switching means is in a closed state, said suction means performs sucking and, after that, said supply patch switching means is put into an open state.

5. The inject recording means according to claim 4, wherein said sucking means decreases a suction ability substantially at the same time when said supply path switching means is put into an open state.

6. The ink jet recording apparatus according to claim 4, wherein said sucking means increases the suction ability substantially at the same time when said gap forming means forms the gap between said cap and said discharge port surface.

7. The ink jet recording apparatus according to claim 1, wherein said gap forming means contains angle correction means for corroding an angle of said cap and separation means for acting on the angle correction means and separating one end of said cap from said discharge port surface.

8. The ink jet recording apparatus according to claim 1, wherein said recording means has a plurality of discharge port columns provided generally in parallel, which discharge the ink of different color for each discharge port column, and said cap collectively cover said plurality of discharge port columns in common.

9. The ink jet recording apparatus according to claim 8, wherein the communication portion with said sucking means of said cap is provided at the one end portion side in relation to the longitudinal direction of said discharge port columns, and the communication portion with said communication valve of said cap and the gap formed by said gap forming means are provided at the other end portion side in relation to the longitudinal direction of said discharge port columns.

10. The ink jet recording apparatus according to claim 1, wherein the inside of said cap is provided with an absorber.

11. The ink jet recording apparatus according to claim 1, wherein said recording means is provided with an electrothermal converter which generates thermal energy to be utilized for discharging the ink from said discharge port.

12. A recovery method of the ink jet recording apparatus which discharges ink from a discharge port provided on the discharge port surface of recording means comprising:

a sucking step of sucking ink from said discharge port by sucking means in a state of the cap closely contacting said discharge port surface;

a first expelling step of generating a gap between said cap and said discharge port surface and expelling ink inside said cap by said sucking means; and a second expelling step of closely contacting said cap on said discharge port surface with a communication valve for communicating the inside of said cap with an atmosphere put into a communication state and expelling ink inside said cap by said sucking means.

13. The recovery method of the ink jet recording apparatus according to claim 12, wherein, in said first expelling step, the gap between said cap and said discharge port surface is partially formed.

14. The recovery method of the ink jet recording apparatus according to claim 12, wherein said sucking means is such that, when said cap adheres on said discharge port surface and supply path switching means which switches the supply path of the ink to said recording means is put into a closed state, said sucking means performs sucking and, after that, said supply path switching means is put into a closed state.

15. The recovery method of the ink jet recording apparatus according to claim 14, wherein suction ability of said sucking means is decreased substantially at the same time when said supply path switching means is put into an open state.

16. The recovery method of the ink jet recording apparatus according to claim 12, wherein, in said first expelling step, said suction ability of said sucking means is increased substantially at the same time when said gap forming means forms the gap between said cap and said discharge port surface.

17. The recovery method of the ink jet recording apparatus according to claim 12, wherein said recording means has a plurality of discharge port columns provided in generally in parallel, which discharge ink of different color for each discharge port column, and said cap collectively covers said plurality of discharge port columns in common.

* * * * *

UNITED STATES PATENT AND TRADEMARK OFFICE

CERTIFICATE OF CORRECTION

PATENT NO. : 6,578,948 B2
DATED : June 17, 2003
INVENTOR(S) : Shima

It is certified that error appears in the above-identified patent and that said Letters Patent is hereby corrected as shown below:

Column 10,
Line 5, “first, fifth” should read -- first and fifth --.

Column 11,
Line 3, “cal” should read -- cam --.

Column 12,
Line 16, “cum” should read -- cam --; and
Line 33, “flowed” should read -- flowed to --.

Column 13,
Line 13, “110a” should read -- 101a --.

Signed and Sealed this

Ninth Day of December, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,578,948 B2
DATED : June 17, 2003
INVENTOR(S) : Shima

It is certified that error appears in the above-identified patent and that said Letters Patent is hereby corrected as shown below:

Title page,
Item [57], ABSTRACT,
Line 2, “of” should read -- of a --;
Line 4, "sucking" should read -- a sucking --;
Line 6, "contacted" should read -- contacting -- and "gap" should read -- a gap --; and
Line 8, "surface," should read -- surface, and --.

Column 1,
Line 24, "wave" should read -- waves --;
Line 31, "droplet" should read -- droplets --; and
Line 41, "be also" should read -- also be --.

Column 5,
Lines 9 and 60, "shorten" should read -- shortened --; and
Line 27, "cap" should read -- cap to --.

Column 6,
Lines 10 and 13, "head" should read -- head is --;
Line 22, "a n" should read -- an --;
Line 40, "is" should read -- is a --; and
Line 45, “color” should read -- colors --.

Column 9,
Line 60, "is" (second occurrence) should read -- is a --.

Column 14,
Line 4, "of" should read -- of a --;
Line 8, "contacted" should read -- contacting --;
Line 10, "surface;" should read -- surface; and --;
Line 17, "contacted" should read -- contacted to --;
Line 32, "inject" should read -- ink jet --; and
Line 50, "cover" should read -- covers --.

UNITED STATES PATENT AND TRADEMARK OFFICE

CERTIFICATE OF CORRECTION

PATENT NO. : 6,578,948 B2
DATED : June 17, 2003
INVENTOR(S) : Shima

It is certified that error appears in the above-identified patent and that said Letters Patent is hereby corrected as shown below:

Column 15,
Line 3, "of" should read -- of a --; and
Line 4, "by" should read -- by a --.

Column 16,
Line 17, "in" should be deleted.

Signed and Sealed this

Sixth Day of January 2004

JAMES E. ROGAN
*Director of the United States Patent and Trademark Office*